United States Patent [19]

Heredero

[11] Patent Number: 4,482,883

[45] Date of Patent: Nov. 13, 1984

[54] ANNULAR POTENTIOMETER WITH TERMINAL

[75] Inventor: Juan L. Heredero, Badalona, Spain

[73] Assignee: Piher Sociedad Anonima, Madrid, Spain

[21] Appl. No.: 538,358

[22] Filed: Oct. 3, 1983

Related U.S. Application Data

[63] Continuation of Ser. No. 476,044, Mar. 21, 1983, abandoned, which is a continuation of Ser. No. 367,315, Jun. 6, 1973, abandoned.

[30] Foreign Application Priority Data

Jul. 30, 1968 [ES] Spain ..... 356.952
May 13, 1969 [ES] Spain ..... 367.693

[51] Int. Cl.[3] ..... H01C 9/02

[52] U.S. Cl. ..... 338/163; 338/174; 338/332

[58] Field of Search ..... 338/68, 118, 160–163, 338/167, 170, 171, 174, 175, 202, 332

[56] References Cited

U.S. PATENT DOCUMENTS

| | | | |
|---|---|---|---|
| 2,160,142 | 5/1939 | Hathorn | 338/271 |
| 2,736,783 | 2/1956 | Daily | 338/332 |
| 3,205,466 | 9/1965 | Youngbeck | 338/163 |
| 3,242,453 | 3/1966 | Stout | 338/174 |
| 3,264,594 | 8/1966 | Layland | 338/174 |
| 3,375,478 | 3/1968 | Van Benthuysen | 338/202 |
| 3,377,606 | 4/1968 | Ferrell | 338/174 |
| 3,383,635 | 5/1968 | Vananzi | 338/162 |
| 3,470,519 | 9/1969 | Hatch | 338/162 |

*Primary Examiner*—G. P. Tolin
*Attorney, Agent, or Firm*—Trexler, Bushnell & Wolters, Ltd.

[57] ABSTRACT

A potentiometer comprising a casing having a short height relative to its diameter and constituting a receptacle for a resistor element and a sliding contact for contact with the latter, the resistor element being supported on the bottom of the casing and the sliding contact being arranged in permanent mechanical and electric contact therewith, being of annular and laminar shape and having a diameter substantially equal to that of the resistor, the shape of which constitutes an incomplete circular annulus having a zone of discontinuity exhibiting a small angle, corresponding to a projection formed on the bottom of the casing and serving as a travel-limiting stop in either direction in order to limit the rotational travel of the axial actuating element, the manipulation of which produces the rotation of the sliding contact on the resistor element.

3 Claims, 11 Drawing Figures

ANNULAR POTENTIOMETER WITH TERMINAL

This application is a continuation of Ser. No. 476,044, 3/21/83, now abandoned, which is a continuation of application Ser. No. 367,315, filed June 6, 1973, now abandoned.

The present invention relates to adjustable potentiometers used in electronic circuits for achieving precise adjustment of the circuits.

The potentiometers in question are small-dimension devices, corresponding to modern miniature type designs, although their electrical value, in ohms, may be high, thus constituting an element of great importance for the adjustment of circuit values the characteristics of which are critical and, also, when used in transistorized circuits, for achieving equilibrium of characteristics in various but symmetrical branches of one stage of the circuit.

The potentiometers of the type with which the present invention is concerned are of the carbon type, the resistor elements thereof being constituted by a band or type of graphite or other carbonaceous and electro-resistant compounds, the two ends of which are provided with contact terminals, while a sliding contact (collector) is adapted to establish contact with any desired intermediate point on the resistor, so as to produce a continuous variation between two given values of the latter.

It is an object of the present invention to provide a potentiometer of the above mentioned type having a simplified design, so as to achieve structural simplicity which results in increased reliability of operation, a reduction in the manufacturing costs as a result of a decrease in the manual labor required for assembly of the arrangement, and also a decrease in the number of elements of which the device consists.

On the other hand, it is known that one of the problems affecting the construction of small dimensioned potentiometers resides in the provision of the mechanical and electrical contacts between the connecting terminals to which are coupled the conductors connecting the potentiometer to an external circuit and the resistor element contained in such devices. It has been attempted to provide, by various different processes, the contact between a plurality of appendices derived from the terminals and the ends of the resistor element and, in all cases, there have been encountered problems with respect to electrical communication, a possible formation of local arcs, high-resistance contacts, poor mechanical securing and possible loosening of the connections.

It is another object of the present invention to provide a small dimensioned potentiometer which obviates these disadvantages and provides firm and secure fastening of the ends of the resistor element to achieving the connection thereof in the circuit and the cooperation thereof with a sliding contact.

It is yet another object of the invention to provide a potentiometer in which the ends of the resistor element are secured by means of a plurality of appendices derived from the fixed head of the contact terminals, the appendices being elongated in projecting zones in which is effected the connection of the conductors leading from the circuit with which the potentiometer are associated.

With these and other objects in view, which will become apparent in the following detailed description, the present invention will be clearly understood in connection with the accompanying drawings, in which.

Figure 8:
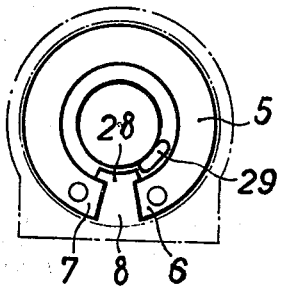
Figure 3:
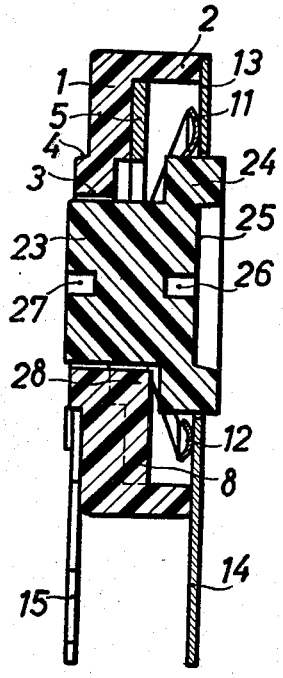
FIG. 3 is a section along the lines 3—3 of FIG. 1.
Figure 11:
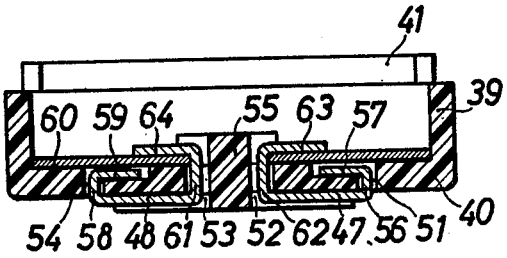
Figure 10:
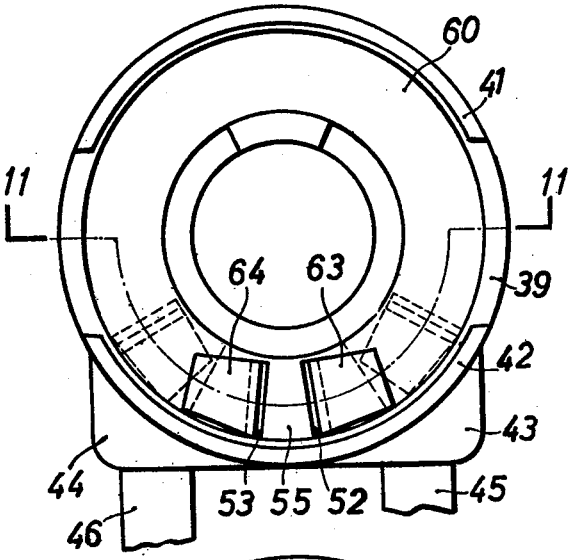
Figure 9:
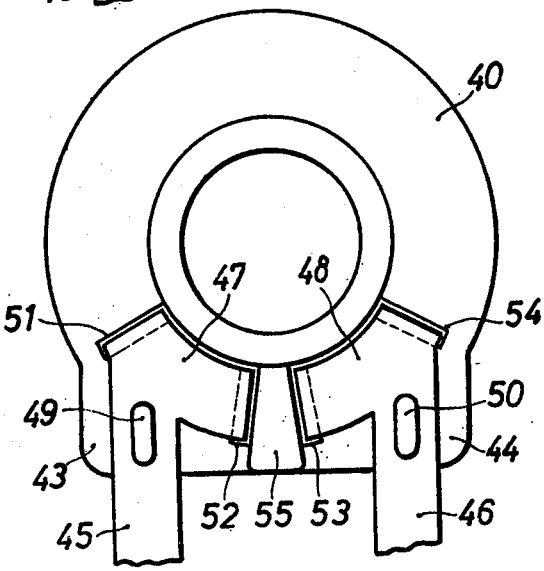

FIG. 8 indicates the shape and form of connecting a resistor element of the device;

FIG. 9 is a front elevation of the casing or framework of the potentiometer, as seen from the exterior, illustrating the shape of the terminals, the free parts thereof, to which are connected the coupling conductors have been omitted from the drawing for clarity;

FIG. 10 is an interior elevation of the casing or framework proper with its terminals and resistant band or tape coupled; and FIG. 11 is a section along the lines 11—11 of FIG. 10 of the assembly comprising the casing, terminals and resistor band, a cylindrical surface coaxial with the potentiometer and the length of which is equivalent to the median circumference of the half thereof containing the terminals.

Referring now to the drawings, an adjusting potentiometer designed in accordance with the present invention comprises essentially a casing or framework 1 of insulating material and a box shape, in the interior of which are disposed the elements constituting the assembly comprising a resistor 5 and a current-tap slide contact 9 which is supported for rotation on a pivot, during its travel on the resistor track. A collector element 13 directly contacts the sliding contact during the entire travel thereof and acts as a lid or cover on the open side of the casing, thereby providing an assembly which is closed and protected with respect to the essential elements thereof. The terminals for brazing to the circuit are firmly secured to the support casing.

The casing or framework 1 is made preferably from an electro-insulating material, for example ceramic, phenolic resin, epoxy resin, thermoplastics material, or the like, having the shape of a circular box, including cylindrical edges 2 which are smooth, and having lodged there within a resistor plate 5 made, for example from graphite, and having the shape of a sectioned annulus fitting in a seat or socket of complementary shape formed in the bottom of the casing. A projection 8 fixes the position of the resistor plate 5 in the radial direction.

From the bottom of the casing there projects a sector of an annulus 28 with which a further similar projection 29 provided on the pivot knob arrangement establishes contact thus acting as a fixed stop or rotation limiting means.

The casing is formed with a circular orifice 3 for the passage of the pivot knob arrangement, and a projection 4 of annular shape serves to reinforce the base thereof.

Contact with the ends 6 and 7 of the resistor is established by means of terminals 17 and 18 made from sheet metal (for example plated brass) and terminates in appendices 15 and 16 of elongated, narrow shape, provided with pointed ends, suitable for introduction into corresponding orifices in a plate or panel carrying a printed circuit.

The sliding contact 9 which provides the contact with an intermediate point on the resistor has the shape of an annulus, having at one side a tip or boss 10 of hemispherical shape, so as to provide a single point contact on the resistor track.

The annular shaped sliding contact bears partly on the pivot or rotation element, for example, over a third portion thereof. The remainder is free and is subjected to a torsion effect in the axial direction, thus imparting to it the force of a spring acting against the resistor track. At the end opposite to that carrying the contact boss there is provided a tongue 30 folded perpendicularly to the plane of the annulus which fixes the position of the slide to the drive element or rotation pivot.

The slide establishes electrical contact with the collector through two bosses 11 and 12 stamped in the plane portion of the annulus equidistant from the point of contact with the resistor, in opposite directions, in such manner that they act as a torsion-force support point in respect of the contact point reaction on the resistor track.

The collector element 13 performs the collecting of the current tapped from the resistor, at any desired point thereon, via the slide or mobile element. In its plane portion, it has the shape of an annulus the outer side of which is elongated in a plurality of arms 21 and 22 which, bent over perpendicularly to their plane, fit on the outer portion of the potentiometer casing, their ends being folded to the shape of a securing clamp or clip on the plane portion of the casing.

The collector element 13, mounted on the open portion of the casing, acts as a lid or cover, leaving covered, in the interior, the sensitive elements such as the resistor plate 5 and the slide 9.

The collector element 13 is provided with a soldering projection or terminal 14 having a shape appropriate to the system provided for connection to the circuit.

The rotation pivot 23 projects through the two ends of the potentiometer, i.e., through the lower side of the casing and through the collector. Its external shape may correspond to its own diameter (at the side or the orifice 3) or it may be of greater width (at portion 24) with the recess 25, appropriate to any desired manipulation requirements, having the form of, for example, a hexagonal cavity or orifice, a slot 26 and 27 for a screwdriver, or it may be elongated in the form of a control knob or the like.

The portion of the knob pivot arrangement 24 disposed in the interior of the casing and covered by the collector is appropriately shaped, to serve the following purposes:

a. A projection 29 is provided at a convenient point on its periphery and lateral portion; the projection 29 having the shape of a circular sector which, when the entire assembly is rotated, establishes contact with a further similar projection 28 provided at the bottom of the housing and having a diameter of equal size, thus limiting the rotation angle to the necessary extent;

b. The rotation pivot supports the slide which it drives in circular movement on itself, maintaining it in position between the resistor plate and the collector and permitting the slide to be flexible in the axial direction and perfectly securely fixed in the radial direction. For this purpose, there is formed in the zone 31 of the knob pivot arrangement an orifice in which is lodged the tongue 30 projecting from the slide. There may be two or more securing tongues in the case of potentiometers, the dimensions of which make such an arrangement seem advisable.

The rotation pivot is axially secured between the bottom of the casing and the collector at the other end, these elements acting as fixed bushings, providing a perfect stability in the position of the slide when the electrical adjustment has been effected.

The terminals 17 and 18 for contact with the resistor are secured to the casing, for example by means of rivets 19 and 20 and establish connection with the ends of the resistor plate in the following manner;

Each terminal has, at the securing side, two tabs 17', 17'' and 18', 18'', respectively, skegs or projections folded to form a U-shape with the corresponding ends of the terminal 17 and 18, which projections are introduced through one orifice in each case formed in the casing 1. First, one of the projections is folded and engaged in the bottom of the casing, then the resistor plate is placed in position and the other projection is folded over in the direction opposite to that of folding of the first projection, over the resistor plate, thus establishing direct contact between the terminal and the resistor and providing a double securing strap.

The terminal is introduced into recesses **17*a* and 18*a*** formed in the axial wall of the casing, and the interior shape of which is the same as that of the terminal. This arrangement prevents any force which may be applied to the terminals from influencing the perfect contact between the latter and the resistor plate.

Figure 6:
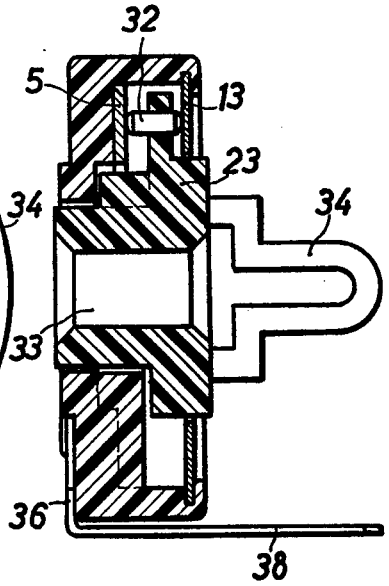
FIG. 6 is a section along the lines 6—6 of FIG. 5.
Figure 7:
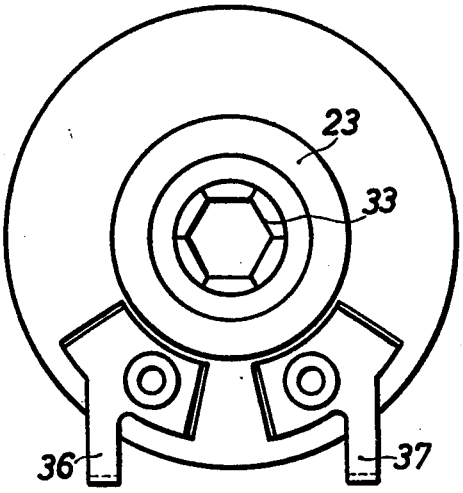
FIG. 7 is a rear elevation of the potentiometer of FIG. 5.

The electrical connection between the resistor 5 and the collector element 13 could be provided, furthermore, instead of through the agency of the slide 9, by means of an electro-conductive element 32, preferably having resilient properties, and which would directly couple the components in the manner shown in FIG. 6. FIG. 6 shows the body 23 having a central perforation 33 of a polygonal section, preferably hexagonal, and the purpose for which is to permit the engagement of a key or tool the head of which has the same shape, or the insertion of a control rod.

The connection of the collector element, in the embodiment of FIG. 6, is effected by means of the terminal 34 and 35, which advantageously are disposed in parallel. The terminals 36 and 37 for the connection of the resistor element, analogous to the elements 15 and 16, are advantageously disposed so as to be cranked at right angles 38, as may be seen in the FIG. 6.

Figure 2:
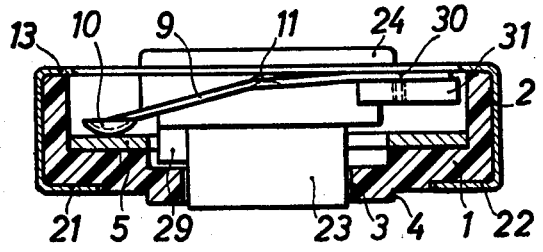
FIG. 2 is a section along the lines 2—2 of FIG. 1.
Figure 1:
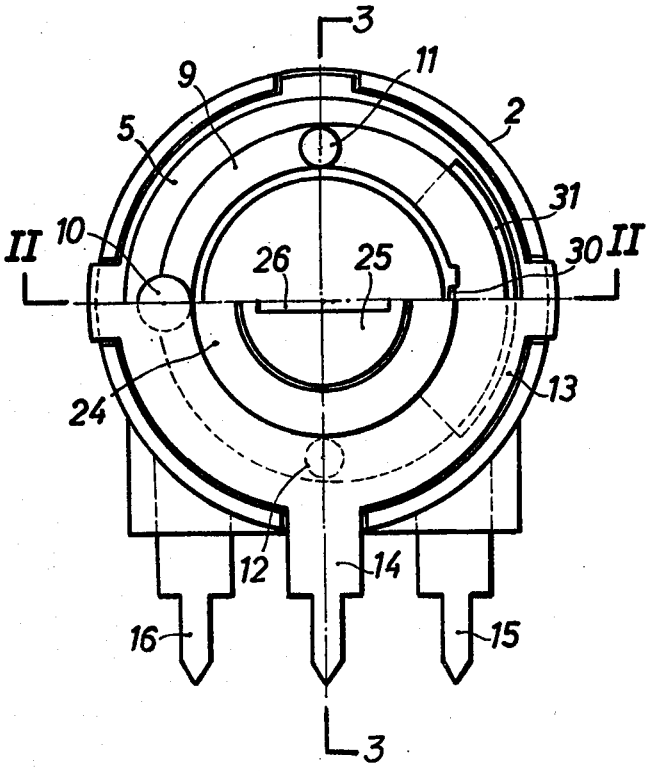
FIG. 1 is a front elevation of a potentiometer design-d in accordance with the present invention.
Figure 4:
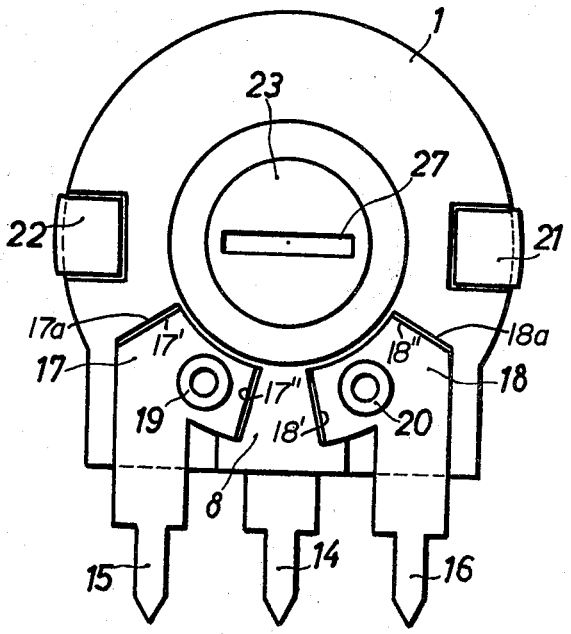
FIG. 4 is a rear elevation of the potentiometer of FIG. 1.
Figure 5:
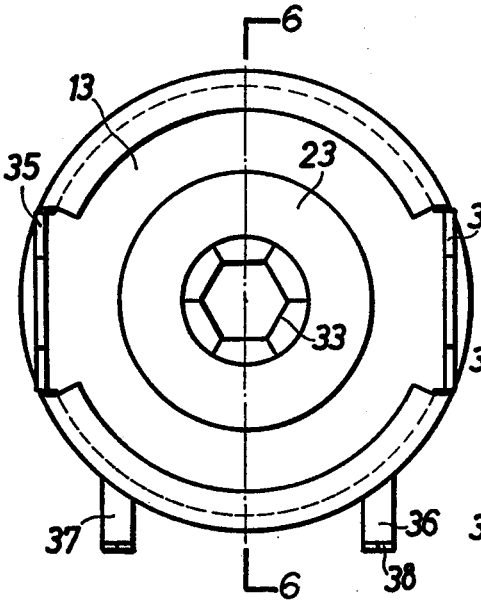
FIG. 5 is a front elevation of another embodiment of the same potentiometer improving the system provided for the actuation of the mobile part thereof and facilitating the coupling of the device, in parallel orientation to a printed circuit plate or panel.

The casing of the potentiometer, which is cylindrical and flattened, comprises circular wall 39 and bottom 40 (according to 2 and 1), the latter being formed with a central perforation 3 for passage of the pivot shaft of the slide. The edges are provided with projections 41 and 42 of symmetrical shape, the purpose for which is to permit the fitting of a lid or cover, and tangential expanded portions 43 and 44, having the shape of triangular flanges or shoulders and serving to secure and support the terminals 45 and 46 which, at their free ends (not shown) are formed, with orifices for facilitating the introduction of the end of the conductors connected to the potentiometer, or pointed terminal portions. The object of this is to facilitate the introduction of the terminals into a plate or panel carrying a printed circuit according to FIGS. 1 and 4.

Referring now again to the drawings, and more particularly to FIGS. 9 and 11, at their heads, the terminals have expanded portions 47 and 48 of curvilinear shape (FIG. 9) and in the portions contiguous with the expanded or enlarged portions, they are formed with perforations conjugated with a plurality of projections of rectangular shape and having rounded ends 49 and 50 which emerge from the surface of the expanded or enlarged portions 43 and 44 and are adapted to contribute to the immobilization of the terminals, when introduced into the apertures formed in the latter.

The bottom 40 of the casing is formed with outermost radial slots 51 and 54 and innermost radial slots 53 and 52, designed to serve for the passage of a plurality of enlarged portions of the zones 47 and 48.

A projection 55 separates the slots 52 and 53 in the central and symmetrical portion of the casing.

The expanded or enlarged portions of the heads of the terminals are introduced into the apertures, and FIG. 11 illustrates how the flange 56, passing through the gap or slot 51, is folded over parallel to the zone 47, remaining lodged in a recess formed in the inner surface of the bottom 40, the depth thereof being equal to the thickness of the laminar material constituting the terminal, more specifically, to the thickness of the end 57, so that the latter is flush with the surface. In a similar manner, the end 59 of the appendix 58 associated with the slot 54 is flush with the inner surface of the bottom 40.

The resistor element of the potentiometer comprises a member of laminar structure having the shape of an incomplete circular annulus one of its faces being covered with a layer of a material, such as graphite, having electro-resistant properties possessing an appropriate ohmic value. The terminals 45 and 46 are connected to the ends of this member, constituting the input and output of the resistor circuit defined in conjugation with the exterior, the slide being circularly displaced on the surface of the resistant layer.

Mechanical securing and electrical contact with the ends of the resistor member 60 are provided by means of the appendices 61 and 62 of the heads 47 and 48 of the terminals, for which purpose the end portions 63 and 64 of the appendices 61 and 62, respectively are folded over on the ends of the circular band or tape, as shown in FIGS. 10 and 11.

Essential advantages achieved by the present invention are as follows.

1. A total protection of the parts of the electro-resistant element and of the metallic slide contact in the interior of the closed casing is achieved. This prevents the entry of dust and also accidental contact with these elements by a person manipulating other components of the assembly of which the potentiometer forms a part; it also prevents any possibility of touching the resistor element with an implement or tool used for other purposes, thus possibly scratching it or producing undesirable electrical shunt effects.

2. The stop limiting the rotation of the rotary element is arranged in a position which does not make the positioning of the elements difficult.

3. The collector element is of annular shape and has a diameter practically identical with that of the resistor element, thus enabling the collector to contact the latter, via the slide contact, within the same radius. This is due to the adjacent or superposed position of the two components, i.e., the resistor and the collector, and to the fact that the collector is not disposed within the resistor. In this way, it becomes possible to substantially reduce the overall dimensions of the potentiometer.

4. Increased security or reliability with respect to the contacts is provided, inasmuch as the latter are relatively hard, due to the resilient properties of the slide and the geometrical shape thereof.

Particular notice should be given to the advantages derived from the annular design of the slide and from the fact that the dimensions thereof are practically equal to those of the circular resistor band, so that the point of contact on the latter is rotated in a circle the radius of which is, in practice, equivalent to that of the two points of contact with the collector. The result of this is a diminution in size and also a reduction in the possibility for breakdown due to deformation of the slide, inasmuch as the latter has no resilient arms or tongues, in the downward direction, so that its mechanical rigidity is improved and its electrical connection more secure.

As a variant of the system described, it would be possible to provide a casing or framework made of thermoplastic material, the securing of the collector at its annular portion being effected by means of a peripheral flange. In this case ultrasonic means, high frequency means or the like are used. Employing this system, the metal skegs which secure the collector and which extend externally of the casing would be eliminated, having the advantage of suppressing external metallic elements which might result in accidental or undesired electric contact.

With the arrangement discussed, the angular travel of the slide may be larger than with known designs of potentiometers of this type, since the mode of securing the ends of the resistor band does not constitute an obstacle for the slide, inasmuch as it is restricted to the terminal portion of the band, it being possible to design the end portion 63 and 64 with an appropriate length, in the direction of the circular travel path of the slide, to ensure that the angular rotation of the latter approaches closely to 360° of the circumference.

The mechanical securing of the terminals is completely reliable and the electrical connection of the resistor element is practically free from local arcs and defective contacts.

While I have disclosed several embodiments of the present invention, it is to be understood that these embodiments are given by example only and not in a limiting sense.

I claim:

1. A potentiometer, comprising a casing having a small height compared to its width, a resistor element mounted in the bottom of said casing, a sliding contact in permanent mechanical and electrical contact with said resistor element and having an annular and laminar shape and a diameter substantially equal to that of said resistor element, a pivot knob axially and rotatingly mounted in said casing and extending therefrom toward the outside of said casing and directly actuatable from outside said casing and forming a pivot which is operatively connected to said sliding contact for rotating the latter on said resistor element, said resistor element forming an annulus cut away having facing ends defining therebetween a discontinuity of a small angle, a projection formed on the bottom of said casing and substantially extending over an arc substantially equal to said small angle discontinuity and positioned thereat and formed as a limit stop for limiting in either direction the rotation travel of said pivot knob, contact terminals completely rigidly secured to the ends of the potentiometer and each constituting one element of laminar structure and elongated configuration, said casing has a circular bottom wall formed with two innermost adjacent radial slots and two outermost radial slots in symmetrical arrangement and recesses formed in the inner surface of said circular bottom wall communicating with said outermost of said radial slots and having a depth substantially equivalent to the thickness of the material constituting said contact terminals, said contact terminals include terminal heads constituting expanded portions of curvilinear shape terminating at portions connected to the potentiometer and forming a substantially trapezoidal zone having lateral elongations thereof, the later being folded at right angles and passing through said radial slots, one of said lateral elongations of each terminal head being folded down and applied over said recesses in such a manner that the folded down end is flush with the inner surface of said circular bottom wall, a plurality of flattened appendices extending tantentially from the base of said casing, said terminal heads of said contact terminals including extensions supported and retained on said flattened appendices, a plurality of bosses extending from the surface of said flattened appendices and having a height slightly greater than the thickness of said extensions of said contact terminals, said extensions of said contact terminals formed with apertures of complementary sectional shape to that of said bosses, and said bosses extending into said apertures locking said extensions to said flattened appendices.

2. The potentiometer, as set forth in claim 1, wherein said resistor element constitutes an annulus of insulating material having a layer of resistant material of predetermined ohmic value deposited on one face, the other face bearing against said bottom of said casing, and gripping means constituting another of said lateral elongations extending through the innermost of said radial slots and said casing has a circular bottom wall formed with innermost and outermost radial slots in symmetrical arrangement and recesses formed in the inner surface of said circular bottom wall communicating with the outermost of said radial slots and having a depth substantially equivalent to the thickness of the material constituting said contact terminals, said contact terminals include terminal heads constituting expanded portions of curvilinear shape terminating at portions connected to the potentiometer and forming a trapezoidal zone having lateral elongations thereof, the latter being folded at right angles and passing through said radial slots, one of said lateral elongations of each terminal head being folded down and applied over said recesses in such a manner that the folded down end is flush with the inner surface of said circular bottom wall, a plurality of flattened appendices extending tangentially from the base of said casing, folded down at right angles parallel to the bottom of said casing bearing precisely over said discontinuous ends parallel to and against said layer of resistant material, thereby non-displaceably retaining and permanently securing and connecting said resistor element and discontinuous ends for electrical connection to said contact terminals.

3. A variable resistance control comprising a molded housing having an opening in one end, a resistance element supported flatwise by said housing, a collector supported substantially flatwise by said housing, said collector being disposed over said opening and closing said opening and spaced from a plane containing said resistance element, said housing being deformed over the collector to secure the collector to the housing, a contactor positioned between said resistance element and said collector, and driver means for rotating said contactor whereby upon rotation of said driver means said contactor wipingly engages said resistance element and said collector.

* * * * *